US009721552B2

(12) United States Patent
Mizrahi

(10) Patent No.: US 9,721,552 B2
(45) Date of Patent: Aug. 1, 2017

(54) FLOOR EFFECT UNIT

(71) Applicant: O.M.B. GUITARS LTD, Efrat (IL)

(72) Inventor: Shimon Mizrahi, Beit Shemesh (IL)

(73) Assignee: O.M.B. Guitars Ltd., Efrat (IL)

( * ) Notice: Subject to any disclaimer, the term of this patent is extended or adjusted under 35 U.S.C. 154(b) by 0 days.

(21) Appl. No.: 15/126,287

(22) PCT Filed: Mar. 16, 2015

(86) PCT No.: PCT/IL2015/050276
§ 371 (c)(1),
(2) Date: Sep. 15, 2016

(87) PCT Pub. No.: WO2015/140791
PCT Pub. Date: Sep. 24, 2015

(65) Prior Publication Data

US 2017/0092251 A1 Mar. 30, 2017

Related U.S. Application Data

(60) Provisional application No. 61/954,917, filed on Mar. 18, 2014.

(51) Int. Cl.
*G10H 3/10* (2006.01)
*G10H 3/14* (2006.01)
(Continued)

(52) U.S. Cl.
CPC ..... *G10H 1/348* (2013.01); *G10H 1/0066* (2013.01); *G10H 1/02* (2013.01); *G10H 2220/061* (2013.01); *G10H 2220/341* (2013.01)

(58) Field of Classification Search
CPC ..... G10H 1/348; G10H 1/0066; G10H 1/02; G10H 2220/061; G10H 2220/341
(Continued)

(56) References Cited

U.S. PATENT DOCUMENTS 3,922,944 A * 12/1975 Kurosaki ..... A63B 71/0622 84/423 R
3,956,958 A * 5/1976 Nash ..... G10H 1/348 84/678
(Continued)

FOREIGN PATENT DOCUMENTS

GB 1535008 A1 12/1978
GB 2033129 A 5/1980
(Continued)

OTHER PUBLICATIONS

International Search Report and Written Opinion of the International Searching Authority Aug. 16, 2015, PCT/IL2015/050276.

*Primary Examiner* — Jeffrey Donels
(74) *Attorney, Agent, or Firm* — PatShegen IP

(57) ABSTRACT

A floor effect unit for actuating a musical effect device is provided. The floor effect unit includes a base plate having at least one electrode configured to collect electric charges; a conductive plate having at least one pressable portion configured to collect electric charges having a polarity opposite to the polarity of charges collected on the electrode, pressable portion being configured such that pressing thereon reduces the distance between the at least one pressable portion and the at least one electrode changing thereby the capacitance therebetween; and a spacer disposed between the base plate and the conductive plate and being configured to provide dielectric gap therebetween, a printed circuit board coupled to the at least one electrode and the conductive plate and being configured to generate an output signal for operating the musical effect device in response to a change in the capacitance.

17 Claims, 4 Drawing Sheets

(51) Int. Cl.
*G10H 1/34* (2006.01)
*G10H 1/02* (2006.01)
*G10H 1/00* (2006.01)

(58) Field of Classification Search
USPC ..... 84/733
See application file for complete search history.

(56) References Cited

U.S. PATENT DOCUMENTS 4,245,539 A * 1/1981 Jones ..... G10H 1/32 84/672
4,491,050 A * 1/1985 Franzmann ..... G10C 3/14 84/746
4,852,443 A * 8/1989 Duncan ..... G10H 1/0551 200/600
5,081,896 A * 1/1992 Hiyoshi ..... G10H 1/00 250/221
5,461,355 A 10/1995 Schemansky et al.
5,864,333 A 1/1999 O'Heir
6,743,971 B1 * 6/2004 Chen ..... G10H 1/32 84/746
6,758,753 B1 * 7/2004 Nagata ..... G10H 1/348 273/148 B
7,387,592 B2 6/2008 Couvillion, Jr.
7,888,612 B1 2/2011 Anderson
8,847,057 B2 * 9/2014 Koah ..... G10H 3/146 84/615
9,006,554 B2 * 4/2015 Roberts ..... G10H 1/0553 84/723
9,111,516 B1 * 8/2015 Saraceni ..... G10H 1/34
9,443,500 B2 * 9/2016 Hoerbelt ..... G10H 1/0091
2009/0058709 A1 * 3/2009 Ueno ..... H04N 5/4403 341/176
2011/0088536 A1 * 4/2011 McMillen ..... G10H 1/348 84/746
2012/0144981 A1 * 6/2012 Ciccone ..... G10H 1/344 84/746
2012/0237904 A1 9/2012 Alicea

FOREIGN PATENT DOCUMENTS

GB 2460496 A 12/2009
NO 2006018299 A1 2/2006
NO 2011163134 A2 12/2011
NO 2013008232 A1 1/2013

* cited by examiner

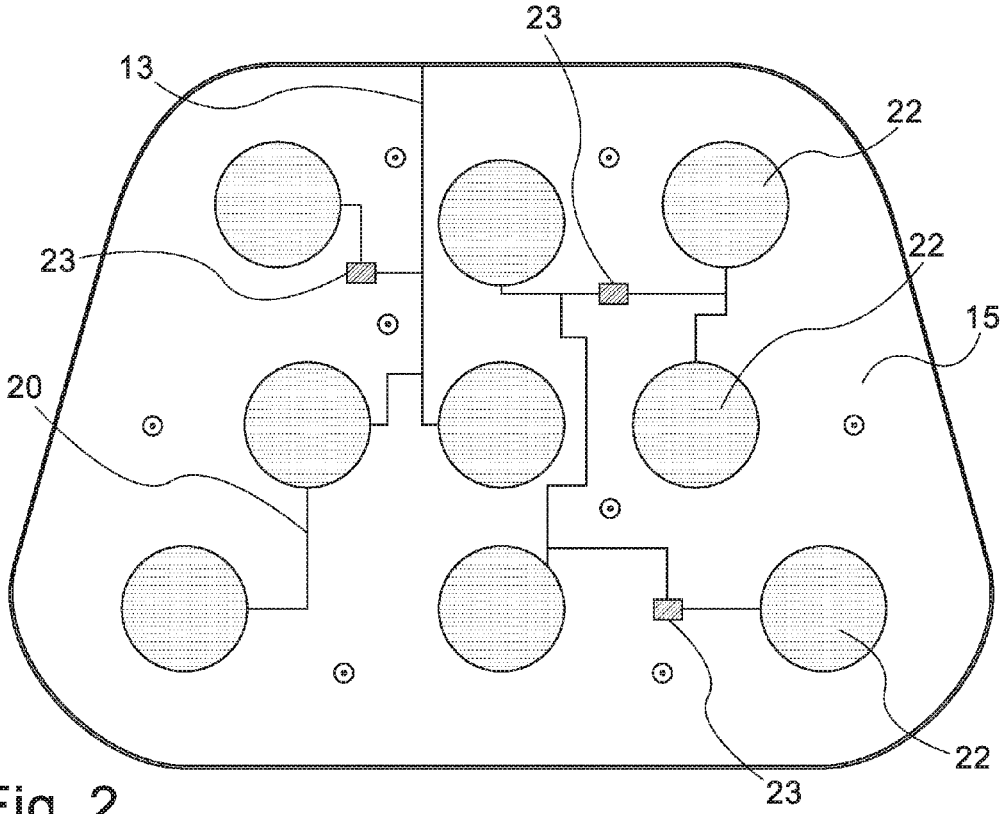
Fig. 2
Fig. 3
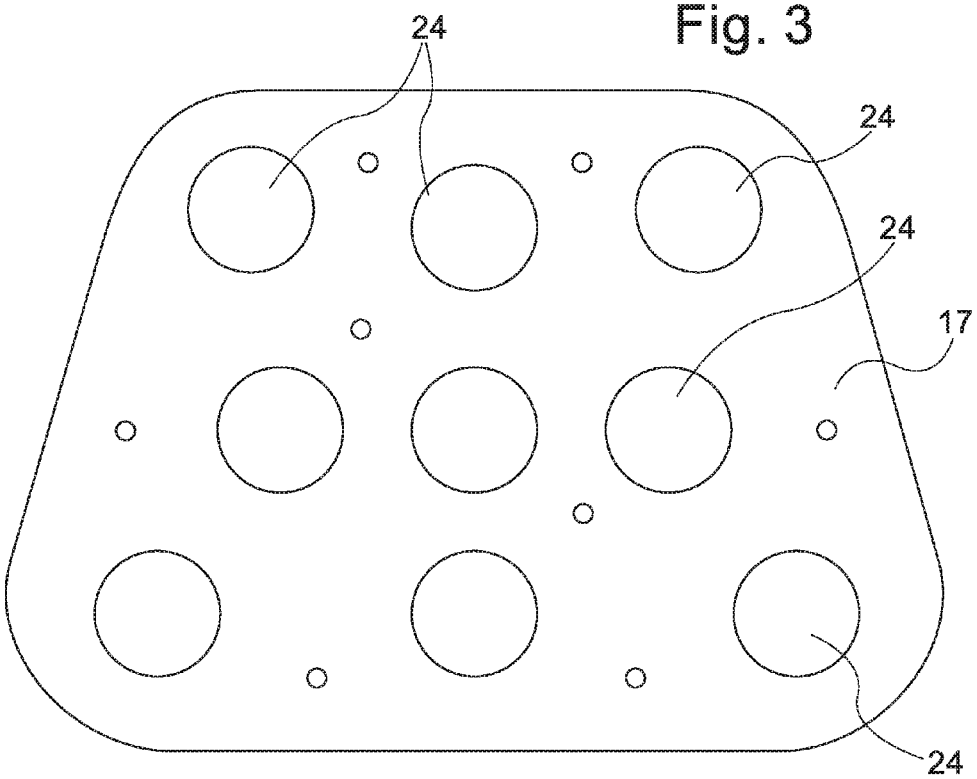

FLOOR EFFECT UNIT

FIELD OF INVENTION

The presently invention relates to a floor effect unit in general, and in particular to a floor effect unit for operating a Musical Instrument Digital Interface (hereinafter MIDI) device.

BACKGROUND OF INVENTION

Floor effect units are known and are vastly utilized form generating musical effects for example for a one man band.

GB 2033129 discloses a musical scale sounds are generated when any of foot-switches in a ring-shaped flexible sheet are depressed. In the flexible sheet, a perforated cushion member of insulating material is inserted between plural pairs of thin electrodes to form the foot-switches. An external circuit including an oscillator, an amplifier and a speaker is connected to the flexible sheet by a cable to generate the musical sound in response to the contact of any of the pairs of the electrodes.

GB2460496 discloses a music device, for example a music teaching aid, comprises a user interface device such as a floor mat which includes a plurality of sound creation regions each associated with at least one sound. Each sound creation region includes a sensor arrangement for sensing when said region is contacted by a user, preferably comprising: two conductive components, separated by an insulator having apertures to allow electrical connection of the conductive components upon application of pressure. A processing arrangement is interactively associated with the user interface device, and is capable of being associated with a speaker arrangement to cause the speaker arrangement to emit a sound associated with the sound creation region contacted by the user. The processing arrangement may be configured to provide instructions to the user via a display arrangement such as a television screen or computer monitor.

U.S. Pat. No. 5,461,355 discloses a foot switch includes a base member having an upwardly facing surface, a force sensing resistor disposed on the surface and coupled electrically to a sensing circuit, and an 'Udi Gabrieli'H actuating layer disposed on the force sensing resistor and the base member surface. The actuating layer has an elevated portion which is substantially centered over the force sensing resistor, the elevated portion having a convex upper surface which is a portion of a spherical surface. The sensing circuit includes a constant current source connected in series with the force sensing resistor between ground and a predetermined voltage.

U.S. Pat. No. 5,864,333 discloses an apparatus for generating control signals for manipulating viewpoints and other objects of a computer generated virtual three dimensional space according to forces exerted by the feet of the user. The apparatus includes shoes, or pads, used beneath the user's feet containing sensors and circuitry for detecting force balances within and between the feet. Force balance signals are input to the computer system and used for generating program control data thereto. The control data are used as thrust and torque vectors for manipulating the location of the viewpoint, and orientation of the view within the virtual space.

SUMMARY OF INVENTION

There is provided in accordance with an aspect of the presently disclosed subject matter a floor effect unit for actuating a musical effect device. The floor effect unit includes a first plate having at least one portion configured to collect positive electric charges; a second plate having at least one opposing portion configured to collect negative electric charges, the second plate being so disposed with respect to the first plate such that the at least one opposing portion thereof is coaxially disposed with respect to the at least one portion of the first plate; a spacer disposed between the first plate and the second plate and being configured to provide dielectric gap between the at least one portion and the at least one opposing portion; at least one pressable portion formed on the first plate or second plate and being configured such that pressing thereon reduces the distance between the at least one portion and the at least one opposing portion changing thereby the capacitance therebetween; and a printed circuit board coupled to the at least one portion and being configured to generate an output signal for operating the musical effect device in response to a change in the capacitance.

The printed circuit board can be defined on the first plate and wherein the at least first portion is an electrode defined on the printed circuit board.

The at least one portion can include a plurality of electrodes each being disposed with respect to the opposing portion such that a capacitor is formed therebetween, and the at least one pressable portion includes a plurality of pressable portions each being configured to change the capacitance between one of the plurality of electrodes and the opposing portion wherein the printed circuit board is configured to generate an unique output signal in response to a change in capacitance for each of the electrodes.

Each of the plurality of electrodes can be configured to collect sufficient amount of charges forming thereby a capacitor with the opposing portion.

The second plate can be a conductive plate.

The at least one opposing portions can include a plurality of conductive regions each being configured to co-operate with one of the plurality of electrodes forming thereby a plurality of capacitors.

The spacer can be made of an electric insulation material, and is provided with a plurality of apertures each being coaxially disposed over one of the electrodes.

The pressable portions can be formed on the second plate and are each configured to be pressed in the direction towards one of the electrodes.

The printed circuit board can be configured to detect a change in characteristics of the capacitor caused by pressing the pressable portions and to produce an output signal in response thereto. Each of the pressable portions can include an elongated cut formed along a perimeter thereof and being configured to allow pressing the pressable portion inwardly with respect to other portions of the second plate. The elongated cut can include four segments, each of which being so defined with respect to other the segments, such that one portion thereof overlaps with an adjacent segments.

The pressable portion can include a strip defined between each of the segments and the adjacent segments.

The strip can be configured such that the pressable portion can be pressed in various angles, such that the pressable portion can co-operate with two electrodes or more.

The floor effect unit can further include an interface plate for configured to operate the at least one pressable portion.

The interface plate can include at least one push button element coaxially disposed the pressable portions.

The push button element can be configured to provide tactile feedback.

Each of the electrodes can include a light source configured to provide an on/off indication.

The floor effect unit can further include an input port configured to receive a signal from a string instrument, the signal includes data identifying the musical note being played on the string instrument; and wherein the output signal further includes the data regarding the musical note.

There is provided in accordance with a further aspect of the invention a floor effect unit for actuating a musical effect device. The floor effect unit includes a base plate having at least one electrode configured to collect electric charges; a conductive plate having at least one pressable portion configured to collect electric charges having a polarity opposite to the polarity of charges collected on the electrode, pressable portion being configured such that pressing thereon reduces the distance between the at least one pressable portion and the at least one electrode changing thereby the capacitance therebetween; and a spacer disposed between the base plate and the conductive plate and being configured to provide dielectric gap between the at least one electrode and the at least one pressable portion, a printed circuit board coupled to the at least one electrode and the conductive plate and being configured to generate an output signal for operating the musical effect device in response to a change in the capacitance.

There is provided in accordance with yet another aspect of the invention a floor effect unit for actuating a musical effect. The floor effect unit includes a first plate; a second plate defining at least one pressable portion spaced apart from the first plate; at least one sensor configured to sense a change in the distance between the pressable portion and the first plate; an input port configured to receive a signal from a string instrument, the signal includes data identifying the note being played on the string instrument; and a printed circuit board coupled to the input port and to the sensor and being configured to generate an output signal including the data and to generate, in response to the change in distance, an output signal for actuating a musical effect.

The output signal can be configured to actuate a MIDI device.

The sensor can include at least one portion on the first plate being configured to collect positive electric charges and a at least one opposing portion on the second plate configured to collect negative electric charges, and a spacer disposed between the first plate and the second plate and being configured to provide dielectric gap between the at least one portion and the at least one opposing portion; wherein the pressable portion is configured such that pressing thereon reduces the distance between the at least one portion and the at least one opposing portion changing thereby the capacitance therebetween.

The sensor can be a piezoelectric sensor.

The pressable portion can include an elongated cut formed along a perimeter thereof and being configured to allow pressing the pressable portion inwardly with respect to other portions of the second plate.

The elongated cut can include multiple segments, each of which being so defined with respect to other the segments, such that one portion thereof overlaps with an adjacent segments. The pressable portion can include a strip defined between each of the segments and the adjacent segments. The strip can be configured such that the pressable portion can be pressed in various angles, such that the pressable portion can co-operate with two sensors or more.

There is provided in accordance with yet another aspect of the invention a method for generating a musical effect with a floor effect unit having a PCB, configured to create an output signal for generating at least one musical effect and at least one button coupled to the PCB being configured to actuate the output signal. The method includes providing the PCB of the floor effect unit with an input signal from a string instrument, the input signal includes data identifying the note being played on the string instrument; pressing the button associated with a desired musical effect; and, generating in response to the pressing, an output signal for actuating a musical effect and an output signal including data regarding the musical note.

Musical effect as used in this application refers to rhythm, beats, modifying the tempo, adding various musical sounds, distortion effects, filter effects for altering the frequency of musical signal, Modulation effect, Pitch and frequency effect, Time-based effect, Audio feedback.

BRIEF DESCRIPTION OF THE DRAWINGS

In order to understand the disclosure and to see how it may be carried out in practice, embodiments will now be described, by way of non-limiting examples only, with reference to the accompanying drawings, in which:

FIG. 2 is a top view of the base plate of the floor effect unit of FIG. 1A;

FIG. 3 is a top view of the spacer of the floor effect unit of FIG. 1A;

DETAILED DESCRIPTION OF EMBODIMENTS

Figure 1A:
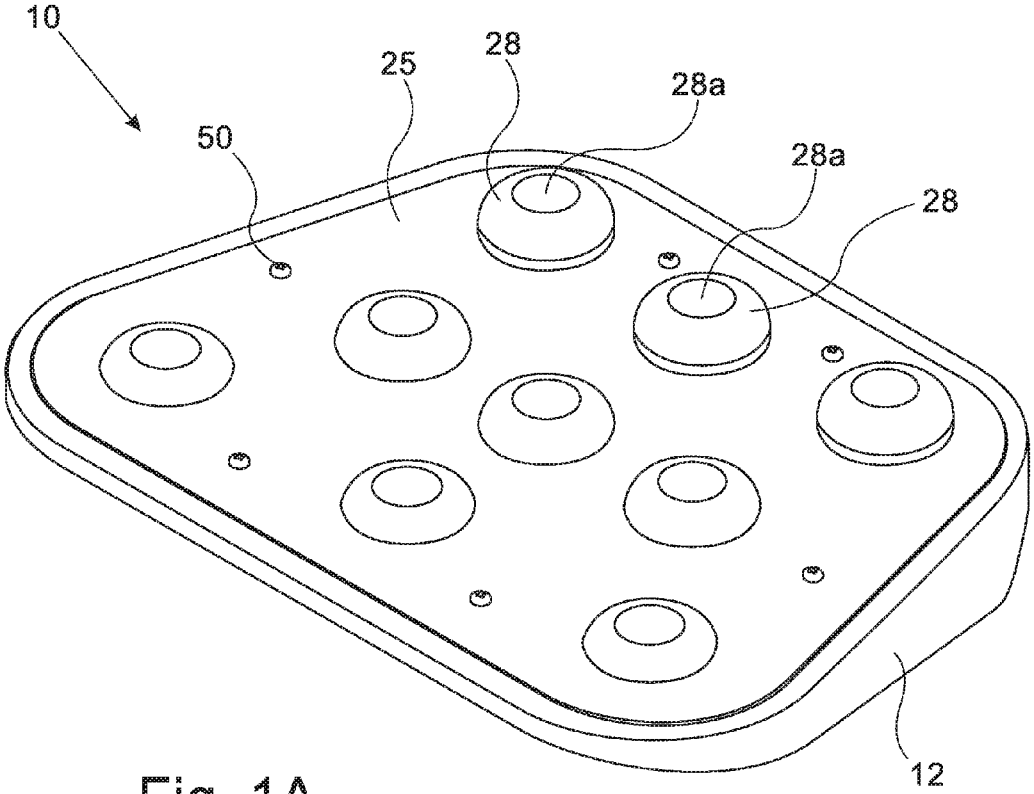
FIG. 1A is a perspective view of a floor effect unit constructed and operative in accordance with an embodiment of the invention.
Figure 1B:
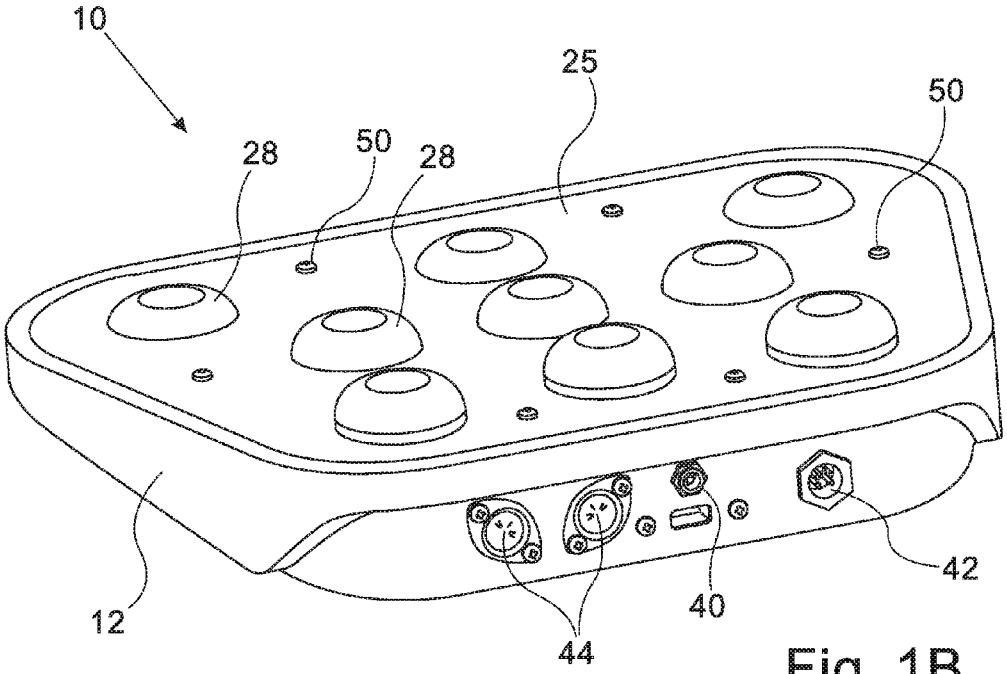
FIG. 1B is a perspective view of the back of the floor effect unit of FIG. 1A.
Figure 1C:
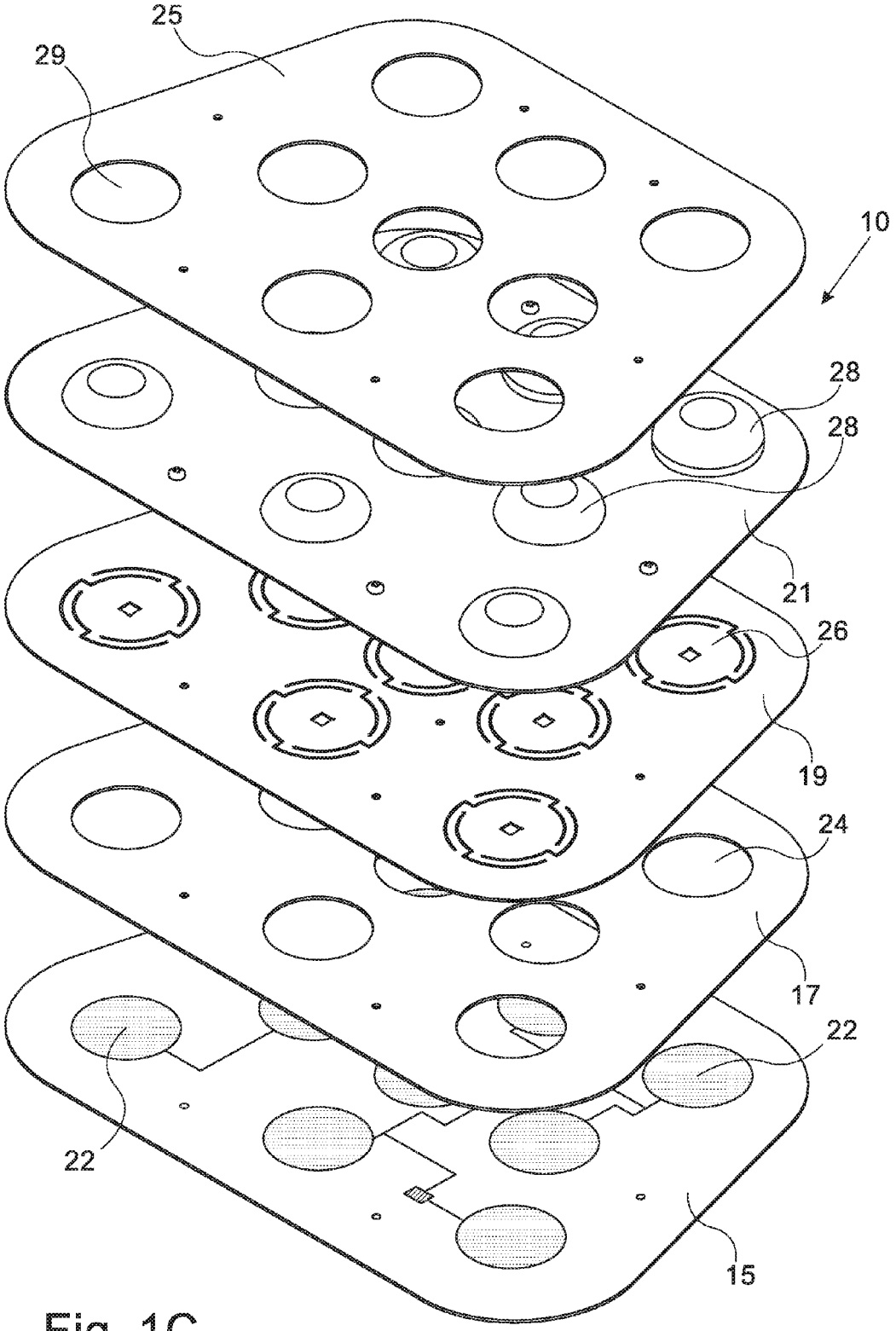
FIG. 1C illustrates an exploded view of the floor effect unit of FIG. 1A.

Reference is now made to FIGS. 1A to 1C, the floor effect unit 10 includes a housing 12 defining a plurality of push button elements 28 each being configured to activate a musical effect. The housing 12 is configured to be disposed on the floor and to be operated by a foot of a user. For example the housing 12 can be configured with a first side thereof higher than an opposing side thereof, such that the interface surface of the housing extending between the first side and the opposing side is disposed with a slope with respect to the floor on which the housing is disposed, facilitating thereby operation of each of the pressing elements 28 by the user's foot.

The housing 12 further includes an electric socket 40 for coupling to an electric source, and an input port 42 configured to receive a signal from a string instrument, such as a guitar. According to an example the input port 42 can be electrically coupled to a detecting system for detecting a musical note played on a string instrument having a fret board provided with a plurality of spaced apart conductive, such as disclosed in PCT/IL2015/050244. Accordingly the floor effect unit 10 receives a signal having data identifying the note being played on the string instrument.

The housing 12 further includes an output port 44 configured to be coupled to a music effect device, such as a MIDI device (not shown). An output signal transmitted through the output port 44 can actuate a plurality of musical effects and operating a plurality of musical instruments or any other features in the MIDI device.

The floor effect unit 10 further includes a base plate 15, a conductive plate 19, and a spacer 17 disposed therebetween encased in the housing 12. The base plate 15 and the conductive plate 19 are configured to form together at least one capacitor which can be used as a switch, as explained hereinafter in detail. The floor effect unit 10 can further include an interface plate 21 configured for operating each of the capacitor switches and a rigid plate 25 providing the interface plate with mechanical protection.

Referring now to FIG. 2, the base plate 15 includes a printed circuit board (hereinafter PCB) 20 defined thereon, being electrically coupled to an electric source, for example to through electric socket 40. Thus the base plate 15 can be made of a plastic material or any substrate suitable for forming thereon a PCB.

The PCB 20 includes a plurality portions configured to collect electric charges thereon, here illustrated as electrodes 22, and a plurality of conductors 13 coupling the various elements of the PCB 20. The electrodes 22 are configured for collecting electric charge thereon. For example, the electrodes can be an area on the PCB which is made of a conductive material and is configured to be electrically charged by conductors 13 which can be coupled to the electric socket 40 or to any other electric source, such as a battery.

The electrodes 22 can be in a size which allows collecting sufficient amount of charges forming thereby a capacitor together with the conductive plate 19, as explained herein below.

The PCB 20 includes electrical components configured to detect changes in capacitance the purpose of which is explained hereinafter. The PCB 20 can further include other electrical components 23 for operating the electrodes 22 and transmitting output signals therefrom, as known in the art. In addition, the PCB 20 can include a microcontroller (not shown) for controlling the transmission of electric signals from the electrodes 22 to other devices coupled to the floor effect unit 10. According to an example the microcontroller is configured to receive a signal from the input port 42, such as signal having data identifying the note being played on a string instrument. The microcontroller can be further configured to generate an output signal including the musical note played on the string instrument and can further actuate a musical effect corresponding to the musical note. The musical effect can be artificially created or enhanced sounds, or sound processes used to emphasize the music played on the string instrument. Thus the microcontroller can be configured to generate a signal for actuating a musical effect with or without a signal including data regarding the note being played on the string instrument coupled to the floor effect unit 10.

Figure 4:
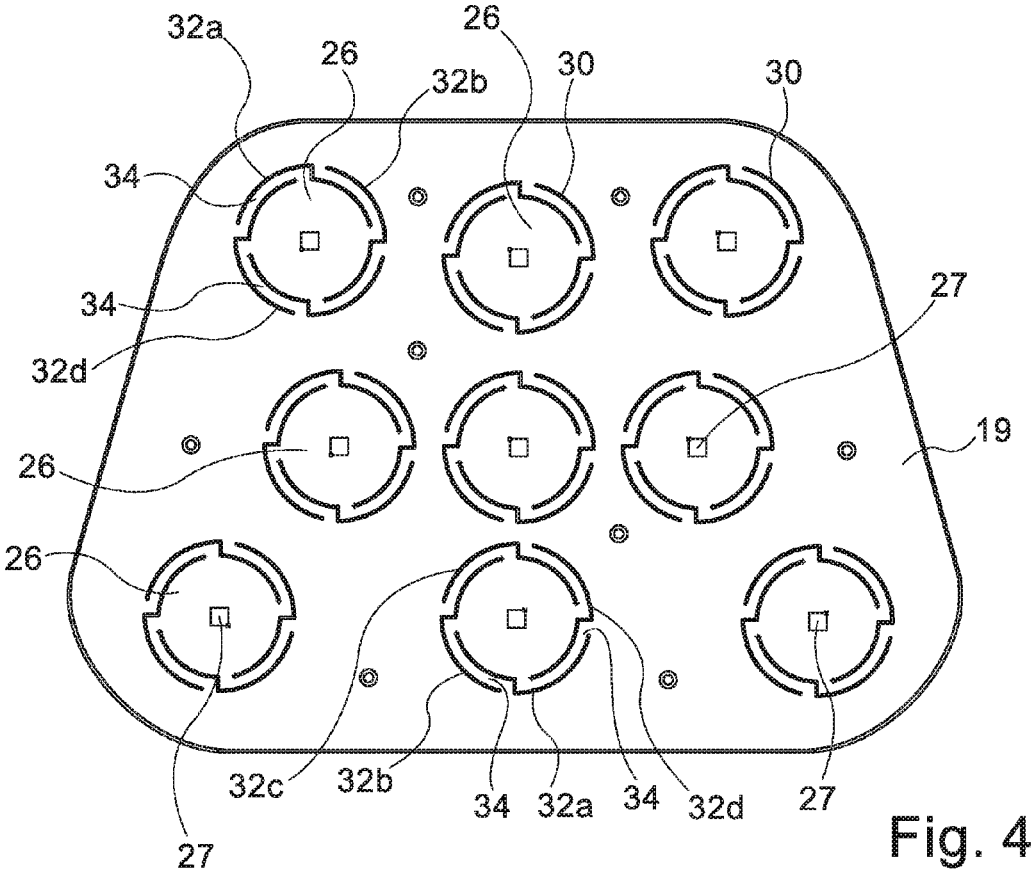
FIG. 4 is a top view of the conductive plate of the floor effect unit of FIG. 1A.

As shown in FIG. 4 the conductive plate 19 has at least one opposing portion configured to collect electric charges, having an opposite polarity with respect to the polarity of the charges collected on the electrodes 22 of the base plate 15.

The conductive plate 19 can be made from a conductive material, such as a metallic plate, such that the entire plate is configured to collect charges thereon having an opposite polarity with respect to the charges collected on the electrodes 22. The conductive plate 19 is coupled to the PCB 20 defined on the base plate 15 and is configured to co-operate with the electrodes 22 defined on the base plate 15, and to form thereby an electric potential across the conductive plate 19 and the electrodes 22.

According to an example, coupling the conductive plate 19 to the PCB 20 is carried out by a fastening element, such as a screw 50 fastening together the base plate 15, the spacer 17 and the conductive plate 19 to the housing 12. Alternatively, coupling the conductive plate 19 to the PCB 20 can be carried out by providing a suitable conductor therebetween.

As shown in the FIG. 2, a plurality of capacitors are formed, in which each of the electrodes 22 defines a first terminal of the capacitor in plate 15 while the conductive plate 19 defines a second terminal. According to an example the electrodes 22 are configured to collect thereon a positive charge while the conductive plate 19 is coupled to the PCB as a ground and is configured to collect thereon negative charge.

It is appreciated that according to other examples the electrodes 22 can be configured to collect thereon negative charges, while the conductive plate 19 is configured to collect thereon positive charges.

It is further appreciated that the conductive plate 19 can be made of a non-conductive material, however provided with a plurality of conductive regions defined thereon. Each of the conductive regions can be coupled to the PCB 20 of the base plate 15 and is configured to collect thereon charges having an opposite polarity with respect to the charges collected on the electrodes 22. This way each of the conductive regions co-operates with one of the electrodes 22 forming together a capacitor having a two opposing terminals. It is appreciated that the conductive plate 19 is so disposed with respect to the base plate 15, such that the conductive regions are co-axially disposed with respect to the electrodes 22, forming thereby a capacitor in which each of the electrodes 22 defines a first terminal and each of the conductive regions defines a second terminal.

Referring back to FIG. 3, a spacer 17 having a thickness is disposed between the base plate 15 and the conductive plate 19. The spacer 17 is configured to form a non-conductive region between each of the electrodes 22 and the conductive plate 19, or the conductive regions thereon. According to the illustrated example the spacer 17 is made of an electric insulation material, and is provided with a plurality of apertures 24 configured such that when the spacer 17 is disposed over the base plate 15 each of the apertures 24 is coaxially mounted over one of the electrodes 22. This way, when assembled with the conductive plate 19, the air space within the apertures 24 serves as a dielectric between the two terminals of the formed capacitor, namely, the conductive plate 19 collecting charges and the electrodes 22 collecting charges. It is appreciated that the charges collected on the conductive plate having an opposite polarity with respect to those collected on the electrodes.

It is appreciated that the thickness of the spacer 17 can be configured in accordance with the required parameters of the capacitance to be formed across the aperture between the conductive plate 19 and each of the electrodes 22. That is to say, the thickness of the spacer 17 is configured in accordance with the required distance between the first and second terminals of the capacitor, i.e. between the electrodes 22 and the conductive plate 19.

It is appreciated that in order to maintain a constant distance between the base plate 15 and the conductive plate 19, they are made of a rigid material and are rigidly mounted inside the housing 12. The spacer 17, however can be made of any material, and can be either flexible or rigid.

With reference to FIG. 4, the conductive plate 19 includes a plurality of pressable portions 26 configured to be pressed in the direction towards the electrodes 22. The pressable portions 26 are defined such that when the conductive plate 19 is assembled with the base plate 15 and the spacer 17 therebetween, each of the pressable portions 26 is coaxially disposed over one of the apertures 24 and one of the electrodes 22. This way, each of the pressable portions 26 is associated with one electrode 22 and can be pressed towards the respective electrode 22, thereby modifying the distance between the two opposing terminals of the capacitor, i.e the respective portion of the conductive plate 19 and the electrode 22. As a result, the capacitance across the aperture 24 is changed, modifying thereby the characteristics of the capacitor formed between the respective electrode 22 and the conductive plate 19. It is appreciated that according to an example the pressable portions 26 are made as an integral portion of the conductive plate 19 and thus are made of a conductive material forming thereby a terminal configured to co-operate with the electrode 22 of the base plate 15.

It will be appreciated by those skilled in the art that in case the conductive plate 19 is made of a non-conductive martial however provided with conductive regions the conductive regions are defined on the pressable portions 26 such that pressing the pressable portions 26 modifies the distance between the conductive regions and the electrode 22 associated therewith.

According to an example, at least the electrodes 22 of the base plate 15 is made of a rigid material while the conductive regions of the conductive plate 19, such as the pressable portions 26, are made of a flexible martial such which allows pressing thereof towards the electrodes 22. According to this example the flexible material is a shape retaining material such that the pressable portions 26 can be pushed towards the electrode 22 and which is configured to retract away from the electrode when it is not pressed. The PCB 20 can be configured to detect the change in characteristics of the capacitors formed between the electrodes 22 and the conductive plate 19, such as the electric potential thereacross, or the capacitance of the electrodes 22, and to produce an output signal in response thereto.

The output signal can be configured to actuate a device coupled to the floor effect unit 10, such as a musical instrument. Accordingly, each electrode 22 can be configured to actuate an output signal independently from other electrodes. The output signal of each electrode can be predeterminately set to activate a musical effect, a musical instrument etc, or to set an operational command with respect to the signal relating to the musical note played on the string instrument coupled to the floor effect unit 10.

According to the illustrated example the pressable portions 26 can be provided with one or more elongated cuts 30 formed along the perimeter thereof. The cuts 30 are configured to provide each of the pressable portions 26 with flexibility such that it can be pressed inwardly with respect to other portions of the conductive plate 19 and towards the base plate 15. This way, each pressable portion 26 can be independently pressed towards the respective electrodes 22 while other pressable portions 26 defined on the conductive plate 19 remain in place. Accordingly, each of the switches defined by one of the electrodes 22 together with a corresponding pressable portion 26 can be independently activated by pressing the corresponding pressable portion 26.

According to an example the elongated cut 30 includes four partially overlapping segments 32*a*, 32*b* 32*c* and 32*d* defined about the periphery of each of the pressable portions 26. Each one of the overlapping segments 32*a*, 32*b* 32*c* and 32*d* is so defined with respect to other segments, such that one portion thereof overlaps with an adjacent segments. For example, the first overlapping segment 32*a* includes a portion in which the cut overlaps with the successive segment i.e. the second overlapping segment 32*b*. The second overlapping segment 32*b* includes a portion which overlaps with the successive segment i.e. the third overlapping segment 32*c*. The third overlapping segment 32*c* includes a portion which overlaps with the successive segment i.e. the forth overlapping segment 32*d*, which also includes a portion which overlaps with the first overlapping segment 32*a*. Accordingly, the perimeter of each pressable portion 26 includes a pair of overlapping cuts 30 defining a strip 34 therebetween. Since the overlapping segment are not continuous, rather are divided into four segments, as explained hereinabove, the strip 34 is coupled to the middle portion of the pressable portions 26 on one end thereof, and to the conductive plate 19 on the other end thereof.

This way, each of the strips 34 maintains the pressable portion 26 coupled to the conductive plate 19 while the cuts 30 provides the pressable portion 26 with a certain degree of flexibility so as to allow pressing thereof inwardly with respect to the conductive plate 19.

It is appreciated that the width of the strip can be determined in accordance with the required strength and/or flexibly of the pressable portion 26. In addition, the amount and size of the overlapping segments as well as the distance between each segment can be determined so as to achieve the desired flexibility, however without compromising the durability of the pressable portion 26.

In addition the disposition of the strips 34 can be configured such that the pressable portion can be pressed in various angles. This way, the base plate can include more than one electrode disposed below the pressable portion, such that pressing the pressable portion in one angle effects the capacitance between the pressable portion and one of the electrode. Each electrode can thus, be configured to actuate an output signal.

Although in the illustrated example the elongated cut 30 includes four partially overlapping segments 32*a*, 32*b* 32*c* and 32*d*, forming together a circular pressable portion 26, according to other examples the elongated cut 30 can include any number of overlapping segments in any desired shape such that a delimited region is formed thereby having flexibility with respect to other portions of the conductive plate 19.

It is appreciated that other configurations can be adapted so as to provide the pressable portions 26 with flexibility, such that it can be pressed by the user's foot, for example the foot of the guitar player, however, without compromising the durability thereof. It is further appreciated that floor effect unit 10 can include pressable portions having various sizes, various degrees of flexibility and durability, for example in accordance with the intended use of the switch formed thereby. This way, there is no need to provide the floor effect unit with mechanical switches.

Figure 5:
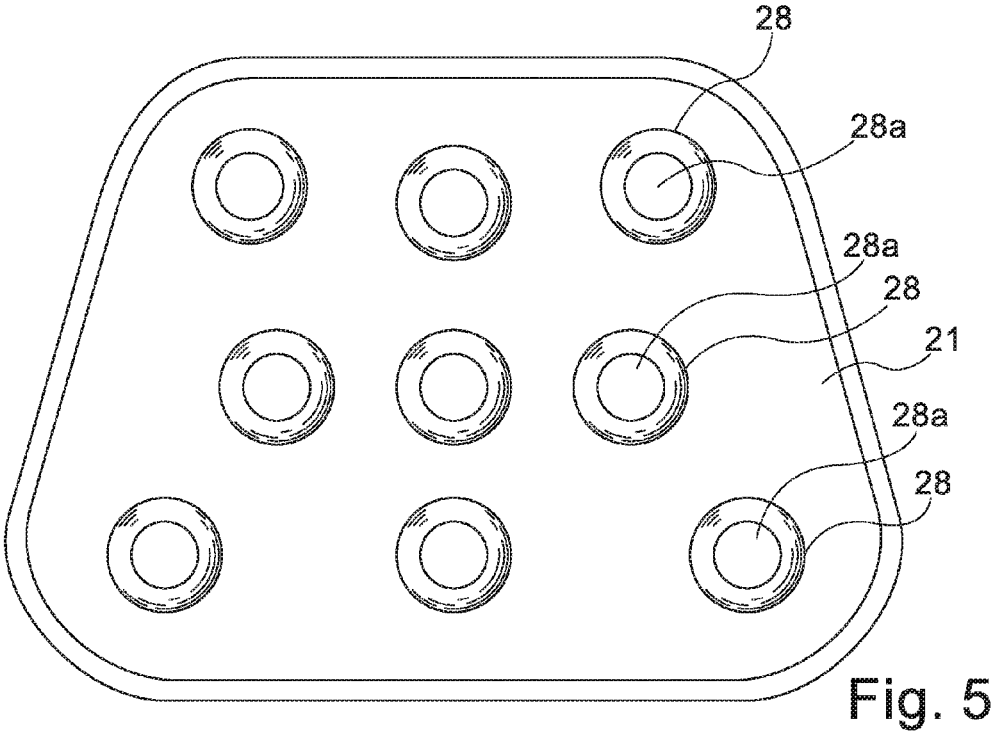
FIG. 5 is a top view of the interface plate of the floor effect unit of FIG. 1A.

Referring now to FIG. 5, the floor effect unit 10 can further include an interface plate 21 configured for operating each of the switches formed by the electrodes and the pressable portions 26. The interface plate 21 can include a plurality of pressing elements 28 upwardly protruding from the surface of the interface plate 21 and disposed thereon such that when the conductive plate 19 is assembled with the base plate 15 and the spacer 17 therebetween, each of the push button elements 28 is coaxially disposed over one of pressable portions 26. The push button elements 28 are configured such that upon pressing thereon the corresponding pressable portion 26 is inwardly pressed with respect to the conductive plate 19 and towards the respective electrode 22. The push button elements 28 can be made of a non-conductive material such that pressing thereon by a user does not interfere the capacitance of the capacitor formed by the conductive plate 19 and the respective electrode 22.

According to an embodiment of the invention, the push button elements 28 can be configured to provide tactile feedback, such that the user pressing thereon can receive a sensory indication regarding the position of the switch formed by the electrode 22 and pressable portions 26. The push button elements 28 can be further provided with an annotation regarding the operation actuated in response to pressing thereon.

According to the illustrated example the interface plate 21 is made of a flexible material, such as rubber, silicone, etc, providing a push button element 28 to facilitate pressing thereon. Thus, the floor effect unit 10 can further include a rigid plate 25 disposed over the interface plate 21 and configured for providing the interface plate 21 with mechanical protection.

The rigid plate 25 includes a plurality of openings 29 configured to allow access to the push button elements 28 to facilitate pressing the push button elements by the user.

It is appreciated that the interface plate 21 can be made of a rigid material having a plurality of flexible elements mounted thereon configured to be pressed and push thereby the pressable portions 26 towards the associated electrode 22. The flexible elements can be spring biased elements, rubber elements, silicone portions etc.

According to an example each of the electrodes 22 includes a light source and each of the pressable portions 26 includes an aperture 27 allowing the light source to illuminate therethrough. The light source can be used as an on/off indication or to indicate sound effect actuated by the respective capacitive switch. The push button elements 28, according to this example, can include a transparent or translucent portion 28*a* configured to allow transmitting illumination from the light source.

The floor effect unit 10 can be coupled through the output port 44 to a MIDI device (not shown) for actuating a plurality of musical effects and operating a plurality of musical instruments or any other features in the MIDI device. According to an example the input port 42 can be electrically coupled to a detecting system for detecting a musical note played on a string instrument having a fret board provided with a plurality of spaced apart conductive, such as disclosed in PCT/IL2015/050244. Accordingly the floor effect unit 10 receives a signal having data identifying the note being played on the string instrument. The signal with the data identifying the note can be transmitted to a MIDI device together or in addition to the musical effect actuated by the floor effect unit.

In operation, in response to pressing on one of the push button elements 28 the respective pressable portion 26 is pushed towards a corresponding electrode 22, thereby changing the capacitance of the electrode 22. The PCB 20 is configured to detect the change in capacitance or change in any other characteristics of the capacitor formed by the electrode 22 and the conductive plate 19. The PCB 20 is further configured to produce an output signal for actuating a feature of MIDI device, such as a MIDI synthesizer.

The floor effect unit 10 thus allows a user to play a string instrument with his hands while actuating musical effects with his foot. The floor effect unit 10 further allows transmitting signal relating to the musical note played by the string instrument, for example, in accordance with data received through the input port 42 from the detecting system provided on the string instrument. The user is further provided with the ability to modify properties of the musical note played by the string instrument, such as volume, tonal response etc. The floor effect unit 10 thus allow transmitting to a musical device, such as a MIDI device an output signal including data regarding a musical note played by the string instrument and the desired effect to accompany the musical note.

According to another example, the PCB with the electrodes can be defined on a top plate of the floor effect unit while the base plate can be made of a conductive material. According to this example each electrode can be made as pressable portions, for example by providing elongated cuts about the periphery thereof. Pressing the presseable portion brings the respective electrode closer to the conductive plate, thereby changing the capacitance therebetween.

According to another example of the invention, the floor effect unit can include a bottom panel having a PCB defined thereon, provided with a plurality of piezoelectric sensors coupled thereto. The PCB can further include various electrical components for operating the piezoelectric sensors and for transmitting output signals therefrom, as known in the art. The floor effect unit further includes a top plate having a plurality of pressable portions defined thereon, substantially the same as the presseable portions 26 of the previous example. The top plate is so disposed with respect to the bottom plate such that the pressable portions defined thereon are coaxially disposed with respect to the piezoelectric sensors defined on the bottom plate. Thus, each pressebale portion and the corresponding piezoelectric sensor form together a switch. Pressing on one of the pressebale portions is detected by the corresponding piezoelectric sensor, and as a response the PCB generates an output signal for actuating a musical instrument or a MIDI device associated with the pressable portion.

Those skilled in the art to which the presently disclosed subject matter pertains will readily appreciate that numerous changes, variations, and modifications can be made without departing from the scope of the invention, mutatis mutandis.

The invention claimed is:

1. A floor effect unit for actuating a musical effect device, the floor effect unit comprising:

a first plate having a plurality of electrodes configured to collect positive electric charges;

a second opposing plate having a plurality of opposing electrodes configured to collect negative electric charges, said second plate being so disposed with respect to said first plate such that each of said plurality of electrodes thereof is coaxially disposed with respect to one of said plurality of opposing electrodes of said first plate;

a spacer disposed between said first plate and said second plate and being configured to provide dielectric gap between said electrodes and said opposing electrodes such that said electrodes on the first plate and said opposing electrodes on the second plate define together capacitors;

a plurality of pressable portions formed on said first plate or second plate and being configured such that pressing on one of said pressable portions reduces the distance between one of said electrodes and one of said opposing electrodes changing thereby the capacitance therebetween; and a printed circuit board defined on said first plate and being coupled to said electrodes said printed circuit board being configured to generate an output signal for operating the musical effect device in response to a change in said capacitance wherein said printed circuit board is configured to generate an unique output signal in response to a change in capacitance for each of said electrodes.

2. The floor effect unit according to claim 1 wherein said printed circuit board is defined on said first plate and wherein said at least first electrode is defined on said printed circuit board.

3. The floor effect unit according to claim 2 wherein each of said plurality of electrodes is configured to collect sufficient amount of charges forming thereby a capacitor with said opposing electrode.

4. The floor effect unit according to claim 1 wherein said second plate is a conductive plate.

5. The floor effect unit according to claim 1 wherein at least one of said opposing electrodes includes a plurality of conductive regions each being configured to co-operate with one of said plurality of electrodes forming thereby a plurality of capacitors.

6. The floor effect unit according to claim 1 wherein said spacer is made of an electric insulation material, and is provided with a plurality of apertures each being coaxially disposed over one of said electrodes.

7. The floor effect unit according to claim 1 wherein said pressable portions are formed on said second plate and are each configured to be pressed in the direction towards one of said electrodes.

8. The floor effect unit according to claim 1 wherein said printed circuit board is configured to detect a change in characteristics of said capacitors caused by pressing said pressable portions and to produce an output signal in response thereto.

9. The floor effect unit according to claim 7 wherein each of said pres sable portions includes an elongated cut formed along a perimeter thereof and being configured to allow pressing said pressable portion inwardly with respect to other portions of said second plate.

10. The floor effect unit according to claim 9 wherein said elongated cut includes four segments, each of which being so defined with respect to other said segments, such that one portion thereof overlaps with an adjacent segments.

11. The floor effect unit according to claim 10 wherein said pressable portion includes a strip defined between each of said segments and said adjacent segments.

12. The floor effect unit according to claim 11 wherein said strip is configured such that the pressable portion can be pressed in various angles, such that said pressable portion can co-operate with two electrodes or more.

13. The floor effect unit of claim 1 further comprising an interface plate for configured to operate said at least one pressable portion.

14. The floor effect unit of claim 13 wherein said interface plate includes at least one push button element coaxially disposed said pressable portions.

15. The floor effect unit of claim 13 wherein said push button element is configured to provide tactile feedback.

16. The floor effect unit of claim 1 wherein each of said electrodes includes a light source configured to provide an on/off indication.

17. The floor effect unit of claim 1 further comprising an input port configured to receive a signal from a string instrument, said signal includes data identifying the musical note being played on said string instrument; and wherein said output signal includes data regarding said musical note.

* * * * *